US011445800B2

(12) United States Patent
Berhault

(10) Patent No.: US 11,445,800 B2
(45) Date of Patent: Sep. 20, 2022

(54) APPLICATOR FOR APPLYING A COSMETIC, MAKEUP OR CARE, PRODUCT TO THE EYELASHES AND/OR EYEBROWS

(71) Applicant: L'OREAL, Paris (FR)

(72) Inventor: Alain Berhault, Saint-Ouen (FR)

(73) Assignee: L'OREAL, Paris (FR)

( * ) Notice: Subject to any disclaimer, the term of this patent is extended or adjusted under 35 U.S.C. 154(b) by 397 days.

(21) Appl. No.: 16/063,020

(22) PCT Filed: Nov. 28, 2016

(86) PCT No.: PCT/EP2016/078967
§ 371 (c)(1),
(2) Date: Jun. 15, 2018

(87) PCT Pub. No.: WO2017/102294
PCT Pub. Date: Jun. 22, 2017

(65) Prior Publication Data

US 2018/0368556 A1 Dec. 27, 2018

(30) Foreign Application Priority Data

Dec. 17, 2015 (FR) ..... 15 62596

(51) Int. Cl.
*A45D 40/26* (2006.01)
*A46B 9/02* (2006.01)
*A46D 1/00* (2006.01)

(52) U.S. Cl.
CPC ..... *A45D 40/267* (2013.01); *A46B 9/021* (2013.01); *A46D 1/0253* (2013.01); *A45D 40/265* (2013.01); *A46B 2200/1053* (2013.01)

(58) Field of Classification Search
CPC .. A45D 40/267; A45D 40/265; A45D 40/264; A45D 40/262; A45D 34/042;
(Continued)

(56) References Cited

U.S. PATENT DOCUMENTS 6,412,496 B1 * 7/2002 Gueret ..... A45D 40/267 132/218
6,616,366 B1 9/2003 Weihrauch
(Continued)

FOREIGN PATENT DOCUMENTS

| | | | |
|---|---|---|---|
| FR | 2 993 441 | A1 | 1/2014 |
| JP | 2009-291344 | A | 12/2009 |
| WO | WO 00/54623 | A1 | 9/2000 |

OTHER PUBLICATIONS

International Search Report dated Feb. 1, 2017 in PCT/EP2016/078967, 5 pages.

*Primary Examiner* — Rachel R Steitz
(74) *Attorney, Agent, or Firm* — Oblon, McClelland, Maier & Neustadt, L.L.P.

(57) ABSTRACT

The present invention relates to an applicator for applying a cosmetic, makeup or care, product to the eyelashes and/or eyebrows, having a moulded applicator member (8) having:—a core (10) that extends along a longitudinal axis (X),—spikes (15, 16) that are carried by the core (10) and are disposed all around the core (10) in a plurality of longitudinal rows (17, 19), wherein, in said applicator, at least one longitudinal row (17) has an alternation of curved spikes (16) that each extend along a curvilinear elongation axis ($E_c$) and straight spikes (15) that each extend along a rectilinear elongation axis ($E_r$).

19 Claims, 2 Drawing Sheets

Figure 1:
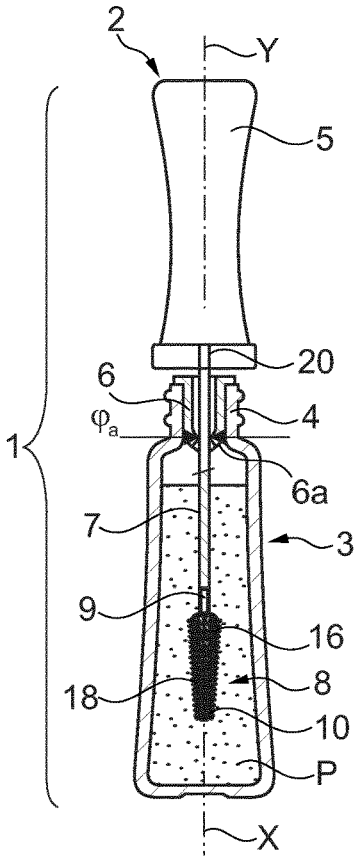

(58) Field of Classification Search
CPC .. A45D 34/043; A45D 34/045; A45D 34/046; A45D 2200/10; A46B 9/021; A46B 2200/1053; A46B 2200/106; A46B 1/00; A46B 3/005; A46D 1/0253; A46D 1/0238
USPC ..... 132/216, 218, 308, 313, 317, 320, 901; D4/132; 401/126, 129; 15/207.2
See application file for complete search history.

(56) References Cited

U.S. PATENT DOCUMENTS

| | | | | |
|---|---|---|---|---|
| 8,794,247 | B2 * | 8/2014 | Kulik | A46B 9/021 132/218 |
| 2001/0035191 | A1 * | 11/2001 | Lee | A46B 9/023 132/160 |
| 2005/0217691 | A1 * | 10/2005 | Petit | A46B 9/021 132/320 |
| 2005/0236008 | A9 * | 10/2005 | Gueret | A46D 1/0238 132/218 |
| 2005/0249539 | A1 * | 11/2005 | Habatjou | A46B 9/021 401/127 |
| 2010/0071715 | A1 * | 3/2010 | Bickford | A46D 1/00 132/218 |
| 2012/0138060 | A1 | 6/2012 | Bickford | |
| 2012/0192892 | A1 | 8/2012 | Kulik | |
| 2014/0096787 | A1 * | 4/2014 | Kim | A45D 40/265 132/218 |

* cited by examiner

APPLICATOR FOR APPLYING A COSMETIC, MAKEUP OR CARE, PRODUCT TO THE EYELASHES AND/OR EYEBROWS

The present invention relates to applicators for applying a cosmetic, makeup or care, product to the eyelashes and/or eyebrows, notably mascara, and to packaging and application devices having a container containing the product to be applied and the applicator.

The container is conventionally provided with a wiping member which wipes the stem of the applicator as it is withdrawn from the container. The behaviour of the applicator member on passing through the wiping member depends on numerous factors, such as the shape and nature of the lip of the wiping member, the joining part between the stem and the applicator member, and the arrangement of the application elements on the applicator member.

A compromise has to be found with regard to the quantity of product which is left on the applicator member for application of makeup. Excessive wiping of the applicator member causes the latter to be insufficiently loaded and obliges the user to frequently dip the applicator back into the container. Insufficient wiping leaves an excess of product that is difficult to manage and could result in clumps of product on poorly separated eyelashes.

The application EP 2 471 409 discloses an applicator having spikes made up of a first, rectilinear portion surmounted by a second, curvilinear portion.

The application US 2012/192892 describes an applicator having, in one and the same longitudinal row, a group of curved spikes and a group of straight spikes that follow one another along the longitudinal axis of the core.

The document U.S. D664,362 discloses an applicator having a plurality of longitudinal rows of curved spikes and one longitudinal row of straight spikes.

There is a need to further improve applicators for applying a product to the eyelashes and/or eyebrows, in order to improve the performance thereof, and more particularly to promote the creation on the applicator member of zones that are more heavily laden with product, which allow easy application of makeup and rapid and abundant loading of the eyelashes and/or eyebrows, while retaining a high capacity to separate the eyelashes and/or eyebrows.

The invention aims to meet this objective and a subject thereof, according to one of its aspects, is an applicator for applying a cosmetic, makeup or care, product to the eyelashes and/or eyebrows, having a moulded applicator member having:

a core that extends along a longitudinal axis, spikes that are carried by the core and are disposed in a plurality of longitudinal rows, wherein, in said applicator, at least one longitudinal row has an alternation of curved spikes that each extend along a curvilinear elongation axis and straight spikes that each extend along a rectilinear elongation axis.

The applicator according to the invention thus has an alternation of curved and straight spikes, making it possible to have better penetration of the eyelashes into the applicator.

The invention makes it possible to obtain zones that form reservoirs on the applicator member, notably between the curved spikes and the straight spikes, said zones being wiped less as the applicator passes through the wiping member, thus providing, for application of makeup, if desired, a surplus of product along the entire length of the core and all around the latter. This surplus of product allows the eyelashes and/or eyebrows to be loaded with a large and satisfactory amount of product from the first application.

During application of makeup, these zones that form reservoirs are emptied gradually of their contents, when the eyelashes and/or eyebrows come into contact with said zones. The eyelashes and/or eyebrows are thus properly loaded with product without the user having to reload the applicator too frequently by reintroducing it into the container.

Moreover, the curved spikes can help to load the eyelashes with more product. The eyelashes have more rapid access to the product situated on these spikes, since, on account of their shape, these spikes have a greater contact surface area with the eyelash, notably in their upper part. This is because, during wiping, the curved spike is wiped less in its upper part.

The alternation of straight spikes and curved spikes makes it possible to benefit from a relatively large number of spikes per row while having spacings between the free ends of two successive spikes that are not too small and which thus do not impair the introduction of the eyelashes between the spikes.

The height and shape of the spikes, and the number and arrangement of curved spikes with respect to the straight spikes, can be varied while the applicator member is being manufactured, in order to adjust the level to which the applicator is loaded with product after wiping.

The expression "longitudinal axis of the core" denotes the line connecting all of the centres of mass of the cross sections of the core. The longitudinal axis may be a central axis, or even an axis of symmetry for the core, notably when the core has a circular cross section or the overall shape of a regular polygon. The longitudinal axis of the core may be rectilinear or curved and may be contained in a plane, which may be a plane of symmetry for some, or even for all, of the cross sections of the core. Preferably, the longitudinal axis of the core is rectilinear.

The term "spike" denotes an individualizable projecting element intended to come into engagement with the eyelashes and/or eyebrows.

A further subject of the invention, according to another of its aspects, is an applicator for applying a cosmetic, makeup or care, product to the eyelashes and/or eyebrows, having a moulded applicator member having:

a core that extends along a longitudinal axis, spikes that are carried by the core and are disposed in a plurality of longitudinal rows, said applicator also having a guard element that is disposed at the proximal end of the core and has a plurality of arcs oriented in the direction of the distal end of the core.

Such an element disposed at the proximal end of the core makes it possible to modify the opening of the wiping member during the withdrawal of the applicator, bringing about less significant wiping of the distal part of the applicator. Compared with an end element which is annular and/or angularly continuous all around the axis of the applicator member, the risk of the piston effect occurring on passing through the wiping member is reduced since air can pass between the arcs. The latter are preferably positioned angularly in the same way as the rows of spikes. However, the number of arcs can be less than the number of rows.

Curved Spikes

Preferably, the elongation axis of the curved spikes has at least one change in curvature direction, notably with a first curve towards the distal end of the core and a second curve in the opposite direction, which straightens the spike. The curved spikes are advantageously produced such that, when they are viewed in front view, at least one of their edges, which follows a curve along at least a portion of its length, changes concavity at one point, referred to as the point of inflection. The tangent at this point then crosses the curve followed by said edge.

The curved spikes are advantageously attached perpendicularly to the core at their bases.

The free end portion of the curved spikes may extend along an elongation axis substantially perpendicular to the longitudinal axis of the core. Preferably, the free end of the curved spikes is offset along the longitudinal axis of the core with respect to the base of the spike, by way of which the latter is attached to the core. For a curved spike situated between two straight spikes, with the axis of its base situated for example between ⅛ and ⅜ of the distance between the axes of the two straight spikes, the offset may be such that the free end of the curved spike is situated between ⅜ and ⅝ of this distance, as measured from the same point along the longitudinal axis of the core.

The curved spikes are advantageously the same height as the straight spikes.

At least one longitudinal row may have an alternation of curved spikes and groups of at least two straight spikes. Preferably, within each longitudinal row, the curved spikes are disposed between groups of straight spikes that each have two straight spikes.

In one variant, a plurality of curved spikes follow one another within one and the same longitudinal row.

Within a longitudinal row, the ratio between the number of curved spikes and the total number of spikes in this row can be between ¼ and ½.

Guard Element

The guard element at the proximal end of the core advantageously has four arcs disposed equidistantly from one another.

The arcs of the guard element may each extend along curvilinear axes.

The arcs of the guard element may have a portion of reduced width between their bases attached to the core and their free ends.

The arcs of the guard element may have a smaller width at their free ends than at their bases attached to the core, preferably being around half the width.

The height of the arcs of the guard element may be equal to the height of the closest spike at the proximal end of the core.

The height of the arcs of the guard element, measured perpendicularly from the core to the free end of the arcs, and perpendicularly to the longitudinal axis of the core, may be between 1.0 mm and 4 mm, better still between 1.9 mm and 2.4 mm.

The arcs of the guard element may have a width of between 0.4 mm and 2 mm, better still between 0.5 mm and 0.95 mm, said width notably being equal to around 0.7 mm. The expression "width of an arc" denotes the greatest transverse dimension of the arc, in section, perpendicularly to the longitudinal axis of the core.

The guard element is advantageously produced in one piece with the core by moulding thermoplastic material. In one variant, the guard element is overmoulded.

The arcs may each be situated in line with a row.

Preferably, the arcs are thicker at their bases than the spikes, so as to be more rigid at their bases and thus to further resist deformation on passing through the wiping member.

The number of arcs may be less than or equal to n/2, where n denotes the number of rows, or less than or equal to n/3.

The arcs may widen at their bases in order to meet, two adjacent arcs together defining a rounded edge that is concave towards the outside, substantially in the form of a quarter circle.

The arcs may have a curved overall shape similar to that of the curved spikes in longitudinal section in a plane containing the longitudinal axis of the core. The arcs may thus be doubly curved, from a base attached substantially perpendicularly to the core, with a first curve towards the distal end of the core and a second curve in the opposite direction, which straightens the arc.

The arcs may all be adjacent to curved spikes, with a distance between the free ends of the arcs and the end curved spikes being less than that between a straight spike and an adjacent curved spike. This reduces the risk of the eyelashes being introduced between an arc and the adjacent spike, in a zone of the applicator member that is likely to be insufficiently laden with product.

Core and Spikes

The spikes advantageously extend from the core and all around the latter. The number of longitudinal rows may be even. There may be at least eight longitudinal rows of spikes in total, notably twelve rows.

The longitudinal rows are preferably rectilinear. The axis of each longitudinal row is preferably parallel to the longitudinal axis of the core.

Each longitudinal row is preferably offset axially with respect to the consecutive longitudinal row. The expression "axially offset longitudinal rows" should be understood as meaning that the spikes of the same rank in these rows do not occupy the same position along the longitudinal axis of the core. Preferably, there is no axial offset between the rows situated in line with an arc of the guard element.

The spikes in two adjacent longitudinal rows may be not joined at their bases.

Within one and the same longitudinal row, the spacing between two straight spikes of ranks n and n+1, measured along the longitudinal axis of the row, between the two respective median planes of the two spikes, may be between 0.5 mm and 2.5 mm, better still between 1 mm and 2 mm, notably being equal to around 1.4 mm.

Within one and the same longitudinal row, the interval between two straight spikes of ranks n and n+1, measured along the longitudinal axis of the row, between the two bases of the spikes facing one another, may be between 0.3 mm and 2 mm, better still between 0.7 mm and 1.7 mm, notably being equal to around 0.85 mm.

Within one and the same longitudinal row, the spacing between a straight spike and the adjacent curved spike, measured along the longitudinal axis of the row, between the two respective free ends of the two spikes, may be between 0.7 mm and 2.5 mm, better still between 1.1 mm and 2 mm, notably being equal to around 1.56 mm.

Within one and the same longitudinal row, the interval between a straight spike and the adjacent curved spike, measured along the longitudinal axis of the row, between the two bases of the spikes facing one another, may be between 0.2 mm and 1.5 mm, better still between 0.4 mm and 1 mm, notably being equal to around 0.5 mm.

The spikes may be disposed around the longitudinal axis of the core along crowns of spikes, two consecutive crowns along the longitudinal axis of the core being offset angularly around the axis by a non-zero angle, notably equal to half the angular pitch between the spikes of a crown. A "crown of spikes" should be understood as meaning a row formed by spikes that occupy one and the same axial position on the longitudinal axis of the core.

At least one straight spike may extend from the core along an elongation axis perpendicular to the surface of the core at the point at which the spike is attached to the core. Preferably, the straight spikes each extend from the core along an elongation axis perpendicular to the surface of the core at the point at which the spikes are attached to the core. This elongation axis may be radial.

The surface of the core to which the spikes are attached may be a rotationally symmetrical surface.

In a variant, the elongation axis of the straight spikes forms an angle other than 90° with the surface of the core at the point at which the spikes are attached to the core.

The height of at least one spike, better still of each spike or of the majority of spikes, measured from the core to the free end of the spike and perpendicularly to the longitudinal axis of the core, may be between 0.5 mm and 4 mm, better still between 0.75 mm and 2 mm.

Preferably, the height of the spikes varies, for example in a monotonous manner, along the longitudinal axis of the core. Within a longitudinal row, the height of the spikes preferably decreases in the direction of the distal end of the core, notably along at least half the visible length of the applicator member. In one variant, the height of the spikes is constant along the longitudinal axis of the core.

The straight spikes advantageously have a conical shape. In variants, said spikes have any shape, notably a cylindrical or tapered, semi-conical, frustoconical or pyramidal shape, in particular with a hexagonal base. In a further variant, the spikes have, in front view, a non-symmetrical shape and an outwardly convex edge, narrow over at least a part of their height in a direction away from the core and have a width that decreases towards said convex edge.

The cross section of the spikes may have a substantially circular, semi-circular (referred to as half-moon), elliptical or semi-elliptical shape, or may also be, for example, polygonal, in particular hexagonal.

At least one spike may be ended by a rounded, in particular hemispherical, free end, the radius of curvature of which may be between 0.08 mm and 0.2 mm, being for example equal to around 0.15 mm.

The spikes may have a thickness of between 0.2 mm and 0.85 mm, better still between 0.45 mm and 0.75 mm, said thickness notably being equal to around 0.5 mm. The expression "thickness of a spike" denotes the greatest transverse dimension of the spike, in section, perpendicularly to the elongation axis of the spike and to the longitudinal axis of the core.

The spikes may have a width of between 0.2 mm and 0.8 mm, better still between 0.35 mm and 0.65 mm, said width notably being equal to around 0.5 mm. The expression "width of a spike" denotes the greatest transverse dimension of the spike, in section, along the longitudinal axis of the core.

The free ends of the spikes of the applicator member define an envelope surface of the applicator member, which is for example in the form of a cylinder of revolution along at least a part of its length.

The envelope surface of the applicator member may have a greatest transverse dimension that is substantially constant along at least a part of the length of the applicator member, notably along more than half the part of the core that carries the spikes.

The envelope surface may also have a cross section that varies along all or part of the length of the applicator member. The cross section of the envelope surface may for example have one or more extremes and for example at least one local minimum and two local maxima. The diameter of the envelope surface that passes through the tops of the spikes of smallest height may be between 5 mm and 7.5 mm, being for example equal to around 5.5 mm. The diameter of the envelope surface of the applicator member that passes through the tops of the spikes of greatest height may be between 6.5 mm and 9 mm, being for example equal to around 8.6 mm.

The core may have a cross section, taken perpendicularly to its longitudinal axis, of any shape, notably of a circular shape. The largest cross section of the core, namely its diameter in the case in which the cross section of the core has a circular shape, may be between 1.8 mm and 3.4 mm, notably being equal to around 2.8 mm.

The core and/or the spikes and/or the guard element may be moulded from one and the same material, or in a variant they can be made from at least two different materials. In variants, the spikes and/or the guard element are overmoulded on the core, or produced by bi-injection-moulding.

The core and/or the spikes and/or the guard element are preferably made of a thermoplastic material, notably of an elastomeric thermoplastic material.

Applicator

The applicator may have a stem that carries the applicator member at a first end and is fixed to a gripping member at a second end.

The core may be solid, being for example moulded with an end piece for fixing to the stem of the applicator. In one variant, the core is hollow.

The applicator member may be fixed to the stem by snap-fastening, adhesive bonding, welding, crimping, pressing, stapling, force-fitting, fitting in a cold state or fitting in a hot state, for example by an end piece of the applicator member being mounted in a housing in the stem. In a variant, the stem is received in a housing provided in the core.

It is also possible for the stem and the applicator member to be moulded or not to be moulded in one piece and from the same thermoplastic material.

The spikes may be made of a material that is more or less rigid than a material used to produce the stem of the applicator to which the core is attached.

The core may extend along a longitudinal axis which, at at least one point along its length, forms a non-zero angle with the longitudinal axis of the stem to which the core is fixed. The applicator member may be angled at its attachment to the stem.

The stem may have a first, rigid portion that is extended on the distal side by a second, more flexible portion, for example made of elastomer, that carries the applicator member.

The visible length of the applicator member may be between 18 mm and 35 mm, better still between 22 mm and 30 mm, being for example equal to around 28.3 mm.

The applicator may have between 150 and 600 spikes, for example between 200 and 300 spikes.

The first spike along the longitudinal axis of the core starting from the stem may be disposed at a non-zero distance from the proximal end of the core, notably between 0.2 mm and 0.7 mm. The last spike along the longitudinal axis of the core starting from the stem may be disposed at a non-zero distance from the distal end of the core, notably between 0.25 mm and 0.9 mm.

The arcs of the guard element advantageously have their free ends situated at a greater distance from the axis of the stem than the end diameter thereof.

Application Device

A further subject of the invention is a device for packaging and applying a product to the eyelashes and/or eyebrows, having an applicator according to the invention, as defined above, and a container containing the product to be applied.

The gripping member of the applicator may form a cap for closing the container.

The container preferably has a wiping member suitable for wiping the stem and the applicator member, having a wiping lip.

The ratio between the diameter of the circumscribed circle that has as its centre the longitudinal axis of the core and passes through the free ends of the arcs of the guard element, in cross section perpendicular to the longitudinal axis of the core, and the diameter of the orifice defined by the lip of the wiping member may be between 0.5 and 2.5.

The product is preferably a mascara.

DETAILED DESCRIPTION

Figure 2:
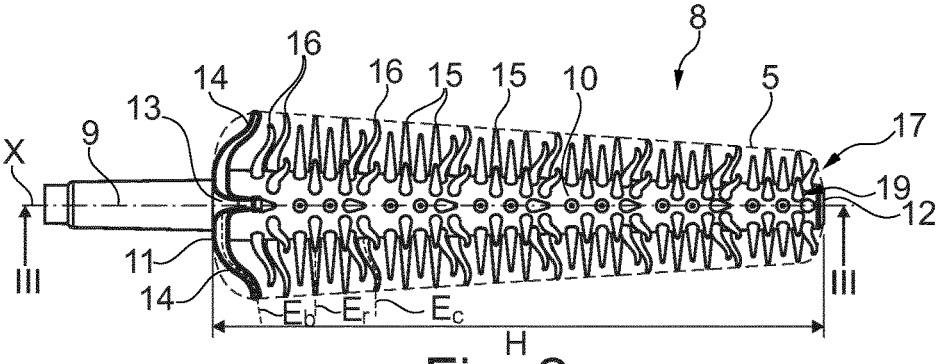
Figure 3:
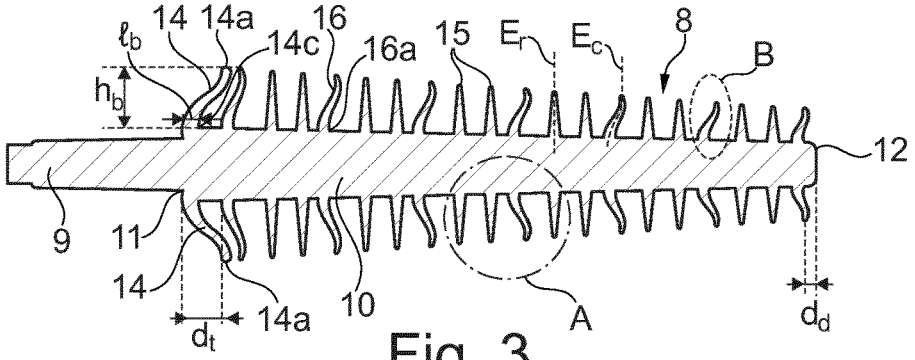
Figure 3A:
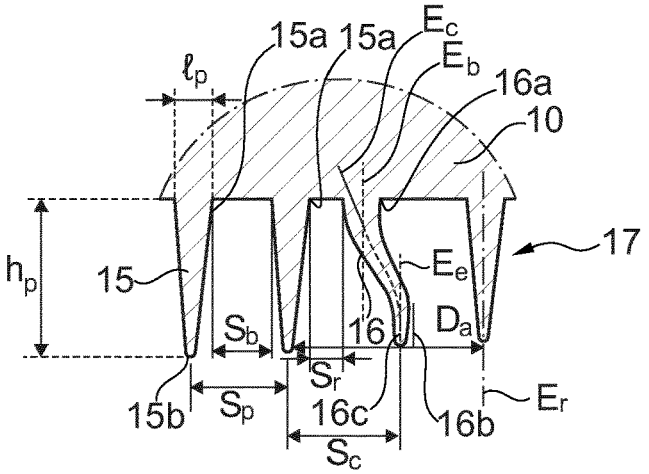
Figure 3B:
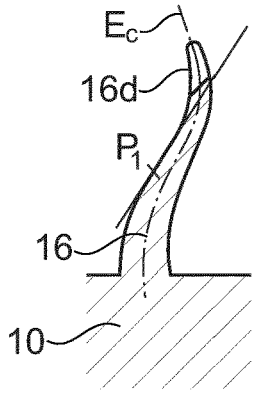
Figure 4:
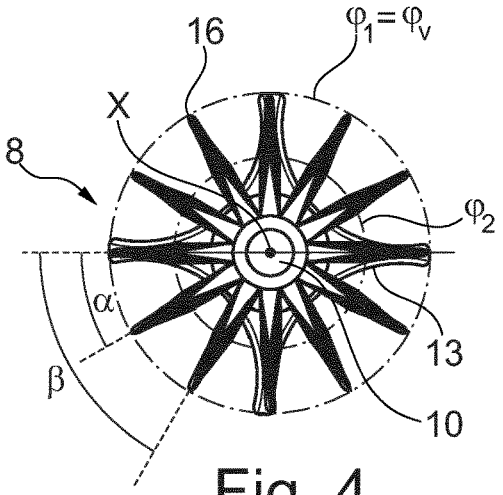
Figure 5:
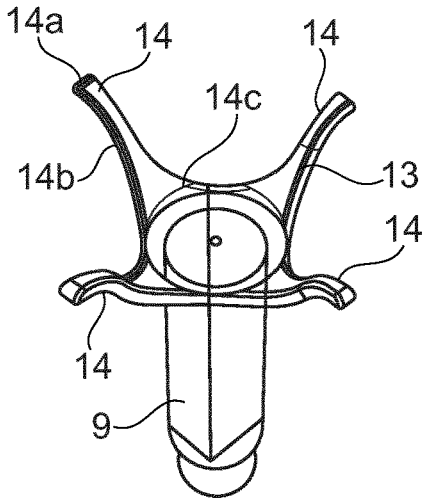
Figure 6:
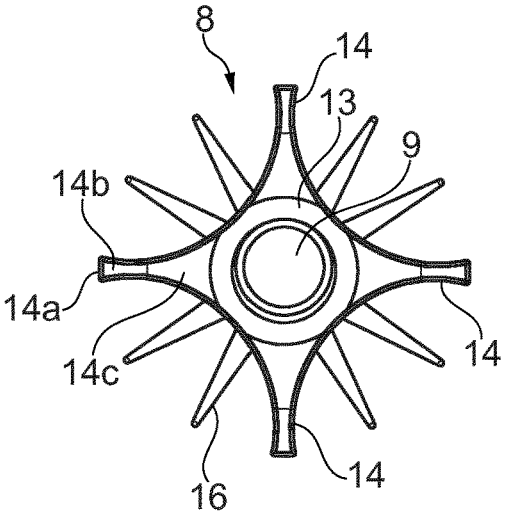

The invention may be better understood from reading the following detailed description of a non-limiting implementation example thereof, and with reference to the attached drawing, in which:

FIG. 1 is a schematic elevation view, in partial longitudinal section, of an exemplary packaging and application device produced in accordance with the invention, FIG. 2 shows a perspective view of the applicator member from FIG. 1 on its own, FIG. 3 is a section along III-III of the applicator member from FIG. 2, FIG. 3A shows a detail of the applicator member from FIG. 3, at A, FIG. 3B shows a detail of the applicator member from FIG. 3, at B, FIG. 4 is a top view of the applicator member from FIG. 2, FIG. 5 shows a perspective view of the guard element of the applicator from FIG. 2, on its own, and FIG. 6 is a bottom view of the applicator member from FIG. 2.

FIG. 1 shows a packaging and application device 1 produced in accordance with the invention, having an applicator 2 and an associated container 3 containing a product P to be applied to the eyelashes and/or eyebrows, for example mascara or a care product.

The container 3 has, in the example in question, a threaded neck 4 and the applicator 2 has a closure cap 5 designed to be fixed on the neck 4 so as to close the container 3 in a sealed manner when it is not in use, the closure cap 5 also constituting a gripping member for the applicator 2.

The latter has a stem 7 of longitudinal axis Y, which is attached at its upper end to the closure cap 5 and at its lower end to an applicator member 8. The latter has a core 10 that carries spikes 15 and 16 that extend from the core 10 and all around the latter. As can be seen in FIG. 2, the first spike 16 along the longitudinal axis X of the core 10 starting from the stem 7 is disposed at a non-zero distance $d_t$ from the proximal end 11 of the core, for example equal to around 0.51 mm. The last spike 16 along the longitudinal axis X of the core 10 starting from the stem 7 is disposed at a non-zero distance $d_d$ from the distal end 12 of the core 10, for example equal to around 0.55 mm.

The container 3 also has a wiping member 6, inserted into the neck 4.

This wiping member 6, which may be of any suitable type, has, in the example in question, a lip designed to wipe the stem 7 and the applicator member 8 when the applicator 2 is withdrawn from the container 3. The lip defines a wiping orifice 6*a* having a diameter adapted to that of the stem 7. The wiping member 6 may be made of elastomer. The wiping orifice 6*a* has for example a circular shape.

The diameter $\varphi_a$ of the wiping orifice 6*a* is typically between 3 and 5.5 mm, being for example around 4.5 mm or 5 mm.

In the example illustrated, the stem 7 has a circular cross section, but if the stem 7 has some other section, this does not depart from the scope of the present invention, it then being possible to fix the cap 5 on the container 3 in some other way than by screwing, if necessary. The wiping member 6 is adapted to the shape of the stem 7 and to that of the applicator member 8, if appropriate.

Preferably, and as in the example in question, the longitudinal axis Y of the stem 7 is rectilinear and coincident with the longitudinal axis of the container 3 when the applicator 2 is in place thereon, but if the stem 7 is not rectilinear, forming for example an elbow, this does not depart from the scope of the present invention.

If need be, the stem 7 may have an annular narrowing at its portion that is positioned opposite the lip of the wiping member 6, so as not to mechanically stress the latter unduly during storage.

As illustrated in FIG. 2, the applicator member 8 may have an end piece 9 for fixing it in a corresponding housing in the stem 7.

The applicator member 8 may be fixed in this housing in the stem 7 by any means, and notably by force-fitting, snap-fastening, adhesive bonding, welding, stapling or crimping.

With reference to FIG. 2, it can be seen that the core 10 has a shape that is elongate along a longitudinal axis X, which is rectilinear in the example described. The longitudinal axis X may be central, as illustrated.

The visible length H of the applicator member 8 is for example equal to 28.3 mm.

In the example described and as can be seen notably in FIG. 2, each longitudinal row 17 has an alternation of curved spikes 16 that each extend along a curvilinear elongation axis $E_c$ and groups of straight spikes having two straight spikes 15 that each extend along a rectilinear elongation axis $E_r$. The circumferential rows situated at the proximal 11 and distal 12 ends of the core 10 advantageously only have curved spikes 16.

Preferably, and as shown in FIG. 3B, the elongation axis $E_c$ of the curved spikes 16 has at least one change in curvature direction, with a first curve towards the distal end 12 of the core 10 and a second curve in the opposite direction, which straightens the curved spike 16. The edges 16*d* of the curved spikes 16 each follow a curve that changes curvature at a point $P_1$, referred to as the point of inflection. The tangent $T_1$ at each point $P_1$ thus crosses the curve followed by the edge 16*d*, as can be seen notably in FIG. 3B.

In the example described, the curved spikes 16 are are attached perpendicularly to the core 10 at their bases 16*a*.

The free end portion 16*b* of the curved spikes 16 may extend along an elongation axis $E_e$ substantially perpendicular to the longitudinal axis X of the core 10. As can be seen notably in FIG. 3B, the free end 16*c* of the curved spikes 16 is offset along the longitudinal axis X of the core 10 with respect to the base 16*a* of the spike 16, by way of which the latter is attached to the core 10. As can be seen notably in FIG. 3A, for a curved spike 16 situated between two straight spikes 15, with the axis $E_b$ of its base 16*a* situated for example between ⅛ and ⅜ of the distance $D_a$ between the axes $E_r$ of the two straight spikes 15, the offset may be such that the free end 16*c* of the curved spike 16 is situated between ⅜ and ⅝ of this distance $D_a$, as measured from the same point along the longitudinal axis X of the core 10.

The spikes 15 and 16 may be disposed on the applicator member 8 in a plurality of rectilinear longitudinal rows 17, 19, as can be seen in FIG. 2, each longitudinal row 17 of spikes being offset axially with respect to the adjacent longitudinal row 19.

In the example in question, the number of longitudinal rows is even, being for example equal to twelve.

The curved spikes 16 are advantageously the same height as the straight spikes 15.

In the example illustrated, the straight spikes 15 each extend from the core 10 along an elongation axis $E_r$ perpendicular to the surface of the core at the point at which the spikes are attached to the core 10.

The straight spikes 15 may have various shapes in cross section. In the example in question, and as can be seen in particular in FIG. 3A, the spikes 15 have a conical shape.

The spikes 15 and 16 in two adjacent longitudinal rows 17, 19 may be not joined at their base, as can be seen in FIG. 2.

As can be seen in FIG. 2, the height of the spikes 15 and 16 may vary along the longitudinal axis X of the core 10. The height may decrease towards the distal end 12 of the core 10, so as to facilitate insertion into the container 3.

The height $h_p$ of the spikes 15 and 16 may be between 1.5 mm and 3.5 mm.

The width $l_p$ of a spike 15, 16 may be between 0.35 mm and 0.65 mm, being for example equal to around 0.5 mm.

As can be seen in FIG. 3A, within one and the same longitudinal row 17, the spacing $S_p$ between two consecutive straight spikes 15 may be between 1 mm and 2 mm, being for example equal to 1.4 mm, as in the example described.

Within one and the same longitudinal row 17, the interval $S_b$ between two consecutive straight spikes 15, measured between the two bases 15*a* of the spikes facing one another, may be between 0.2 mm and 1.5 mm, better still between 0.4 mm and 1 mm, being for example equal to around 0.5 mm.

Within one and the same longitudinal row 17, the spacing $S_c$ between a straight spike 15 and the adjacent curved spike 16, measured between the respective free ends 15*b* and 16*c* of the two spikes, may be between 0.7 mm and 2.5 mm, being for example equal to around 1.56 mm.

Within one and the same longitudinal row 17, the interval $S_r$ between a straight spike 15 and the adjacent curved spike 16, measured between the two bases 15*a* and 16*a* of the spikes facing one another, may be between 0.2 mm and 1.5 mm, being for example equal to around 0.5 mm.

With reference to FIG. 4, the diameter $\varphi_2$ of the envelope surface formed by the spikes 15 and 16 of smallest height may be between 5 mm and 7.5 mm, being for example equal to around 5.5 mm. The diameter $\varphi_1$ of the envelope surface of the applicator member 8 formed by the spikes 15 and 16 of greatest height may be between 5 mm and 11 mm, being for example equal to around 8.6 mm.

As can be seen in FIG. 4, the implantation of the spikes 15 and 16 may be such that the angle $\alpha$ about the longitudinal axis X of the core 10 between two consecutive crowns 21 and 22 of spikes 15 and/or 16, said crowns each being formed by spikes 15 and/or 16 that occupy one and the same axial position on the longitudinal axis X of the core 10, is non-zero, being for example equal to half the angular pitch $\beta$ between two consecutive spikes in a crown.

In the example in question, the free ends 28 of the spikes 15 and 16 define an envelope surface S of the applicator member 8, having a rectilinear longitudinal axis that is coincident with the longitudinal axis X of the core 10, and is rotationally symmetrical about said axis X.

In the example described, and as can be seen in FIGS. 2, 3, 5 and 6, the applicator 2 according to the invention has a guard element 13 disposed at the proximal end 11 of the core 10, having four arcs 14 that extend along curvilinear axes $E_b$ that are oriented in the direction of the distal end 12 of the core 10 and are disposed equidistantly from one another.

Preferably, and in the example described, the arcs 14 have a curved overall shape similar to that of the curved spikes 16 in longitudinal section in a plane containing the longitudinal axis X of the core 10, the arcs 14 being doubly curved from a base 14*c* attached substantially perpendicularly to the core 10, with a first curve towards the distal end 12 of the core 10 and a second curve in the opposite direction, which straightens the arc 14.

As can be seen in FIGS. 5 and 6, the arcs 14 of the guard element 13 have a portion 14*b* of reduced width between their bases 14*c* attached to the core 10 and their free ends 14*a*.

Preferably, and in the example described, the arcs 14 of the guard element 13 have, at their free ends 14*a*, a width around half the width of their bases 14*c* attached to the core 10.

In the example described, the arcs 14 are all adjacent to curved spikes 16, with a distance between the free ends of the arcs 14 and the end curved spikes 16 being less than that between a straight spike 15 and an adjacent curved spike 16, as can be seen in FIG. 3.

In the example described, as can be seen in FIG. 3, notably, the height $h_b$ of the arcs 14 of the guard element 13 is equal to the height $h_p$ of the closest spike 16 at the proximal end 11 of the core 10.

The height $h_b$ of the arcs 14 of the guard element 13 may be between 1.5 mm and 3 mm.

The arcs 14 of the guard element 13 may have a width $l_b$ of between 0.4 mm and 2 mm, being for example equal to around 0.7 mm.

The ratio $\varphi_v/\varphi_a$ between the diameter $\varphi_v$ of the circumscribed circle that has as its centre the longitudinal axis X of the core 10 and passes through the free ends 14*a* of the arcs 14 of the guard element 13 and the diameter $\varphi_a$ of the orifice 6*a* defined by the lip of the wiping member 6 may be between 0.5 and 2.5.

The spikes 15, 16 and the guard element 13 are made, in the example in question, in one piece with the core 10 by moulding thermoplastic material.

In order to mould the applicator member 8, use can be made of any thermoplastic material which is or is not relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA. It is also possible to use a ceramic, for example based on alumina, a resin, for example of the urea-formaldehyde type, and possibly a material containing graphite as filler. It is possible notably to use the materials known under the trade names Teflon®, Hytrel®, Cariflex®, Alixine®, Santoprene®, Pebax® and Pollobas®, this list not being limiting.

In order to use the device 1, the user unscrews the closure cap 5 and withdraws the application member 8 from the container 3.

Once the applicator member 8 has passed through the wiping member 6, a particular quantity of product P remains between the curved spikes 16 and the straight spikes 15, also by virtue of the presence of the guard element 13, creating reservoirs of product P along the entire length of the core 10 and on all sides, making it possible to load the eyelashes and/or eyebrows with product P in a satisfactory manner.

Of course, the invention is not limited to the exemplary embodiment which has just been described.

The applicator member 8 may be able to vibrate, that is to say that it is possible to apply vibrations thereto during application, combing or picking up of the product P, for example as described in the application WO 2006/090343.

In a further variant, the applicator member 8 may be able to rotate, that is to say that it may be made to carry out a rotational movement about the longitudinal axis X of the core 10, for example during application, combing or picking up of the product P.

In a further variant, the applicator member 8 may be heated, that is to say have a heating element for heating the keratin fibres, the eyelashes and/or eyebrows, and/or the spikes 15, 16 and/or the core 10 of the applicator member 8.

It is also possible for the applicator member 8 to be able to vibrate, to be able to rotate and to be heated, or only to be able to vibrate and to be able to rotate, or only to be able to vibrate and to be heated, or only to be able to rotate and to be heated, or only to be able to vibrate or only to be able to rotate or only to be heated.

The applicator member 8 may comprise any bactericidal agent such as silver salts, copper salts, preservatives and at least one preservative for the product P.

The core 10 and/or the spikes 15, 16 may, furthermore, comprise particles, for example a filler, notably a compound which is magnetic, bacteriostatic or absorbs moisture, or else a compound intended to produce roughness on the surface of the spikes 15, 16 or to help the eyelashes and/or eyebrows to slide on the spikes. At least one of the core 10 and a spike 15, 16 may be flocked or undergo any heat treatment or mechanical treatment.

The invention claimed is:

1. An applicator for applying a cosmetic, makeup or care, product to the eyelashes and/or eyebrows, having a moulded applicator member comprising:

a core that extends along a longitudinal axis; and spikes that are carried by the core and are disposed all around the core in a plurality of longitudinal rows, wherein, in said applicator, within the plurality of longitudinal rows, each longitudinal row has an alternation of one curved spike that extends along a curvilinear elongation axis and groups of at least two straight spikes that each extend along a rectilinear elongation axis, and wherein a free end portion of the curved spikes extends along an elongation axis substantially perpendicular to the longitudinal axis of the core, and wherein each curved spike is a same height as at least one adjacent straight spike, within one and a same longitudinal row.

2. The applicator according to claim 1, also having a guard element that is disposed at a proximal end of the core and has a plurality of arcs oriented in the direction of a distal end of the core.

3. The applicator according to claim 1, wherein the elongation axis of the curved spikes has at least one change in curvature direction.

4. The applicator according to claim 3, wherein the elongation axis of the curved spikes has a first curve towards a distal end of the core and a second curve in the opposite direction, which straightens the curved spike.

5. The applicator according to claim 1, wherein a free end of the curved spikes is offset along the longitudinal axis of the core with respect to a base of the spike, by way of which the spike is attached to the core.

6. The applicator according to claim 1, wherein the straight spikes have a conical shape.

7. The applicator according to claim 1, wherein the curved spikes are of a same height as the straight spikes.

8. The applicator according to claim 1, wherein, within a longitudinal row of the plurality of rows, the height of the curved and straight spikes decreases in the direction of a distal end of the core.

9. The applicator according to claim 8, wherein, within a longitudinal row of the plurality of rows, the height of the curved and straight spikes decreases in the direction of a distal end of the core along at least half a length of the applicator member.

10. The applicator according to claim 1, wherein the straight spikes extend from the core along an elongation axis perpendicular to the surface of the core at the point at which the straight spikes are attached to the core.

11. The applicator according to claim 1, wherein the curved and straight spikes are disposed around the longitudinal axis of the core along crowns of spikes, two consecutive crowns along the longitudinal axis of the core being offset angularly around the longitudinal axis by a non-zero angle.

12. The applicator according to claim 11, wherein said non-zero angle is equal to half the angular pitch between the spikes of a crown.

13. A device for packaging and applying a product to the eyelashes and/or eyebrows, having an applicator according to claim 1 and a container containing the product.

14. An applicator for applying a cosmetic, makeup or care, product to the eyelashes and/or eyebrows, having a moulded applicator member comprising:

a core that extends along a longitudinal axis; and spikes that are carried by the core and are disposed in a plurality of longitudinal rows, said applicator also having a guard element that is disposed at a proximal end of the core and has a plurality of arcs oriented in a direction of a distal end of the core, each arc having a base attached to the proximal end of the core and a free end, the arcs being thicker at their bases than the spikes, and the arcs widening and meeting at their bases.

15. The applicator according to claim 14, wherein at least one of the plurality of longitudinal row of spikes has an alternation of curved spikes that each extend along a curvilinear elongation axis and straight spikes that each extend along a rectilinear elongation axis.

16. The applicator according to claim 14, wherein the guard element at the proximal end of the core has four arcs disposed equidistantly from one another.

17. The applicator according to claim 14, wherein the arcs of the plurality of arcs of the guard element have a portion of reduced width between their bases attached to the core and their free ends.

18. The applicator according to claim 14, wherein the arcs of the plurality of arcs of the guard element have a smaller width at their free ends than at their bases attached to the core.

19. The applicator according claim 14, wherein a height of the arcs the plurality of arcs of the guard element is equal to the height of the spike closest to a proximal end of the core.

* * * * *